US011702279B2

(12) United States Patent
Ma et al.

(10) Patent No.: US 11,702,279 B2
(45) Date of Patent: Jul. 18, 2023

(54) BUILT-IN VALVE CHAMBER OF TANK COMPLETELY COVERED WITH SOIL

(71) Applicants: SHANDONG CHAMBROAD HOLDING GROUP CO., LTD., Binzhou (CN); SHANDONG CHAMBROAD EQUIPMENT MANUFACTURE INSTALLATION CO., LTD., Binzhou (CN)

(72) Inventors: Yunsheng Ma, Binzhou (CN); Liqiu Zhao, Binzhou (CN); Ziping Zhang, Binzhou (CN); Shiheng Ma, Binzhou (CN); Qingsong Zhao, Binzhou (CN); Chongchong Zhang, Binzhou (CN); Jiatao Cheng, Binzhou (CN); Shengke Wei, Binzhou (CN); Xingfei Geng, Binzhou (CN)

(73) Assignee: SHANDONG CHAMBROAD EQUIPMENT MANUFACTURE INSTALLATION CO., LTD., Binzhou (CN)

( * ) Notice: Subject to any disclaimer, the term of this patent is extended or adjusted under 35 U.S.C. 154(b) by 0 days.

(21) Appl. No.: 17/998,491

(22) PCT Filed: Apr. 12, 2021

(86) PCT No.: PCT/CN2021/086666
§ 371 (c)(1),
(2) Date: Nov. 11, 2022

(87) PCT Pub. No.: WO2022/141933
PCT Pub. Date: Jul. 7, 2022

(65) Prior Publication Data

US 2023/0134902 A1 May 4, 2023

(30) Foreign Application Priority Data

Dec. 31, 2020 (CN) ..... 202011640962.5

(51) Int. Cl.
*B67D 7/78* (2010.01)
*B65D 90/54* (2006.01)
(Continued)

(52) U.S. Cl.
CPC ..... *B65D 90/54* (2013.01); *B65D 88/76* (2013.01); *B65D 90/22* (2013.01); *E02D 27/38* (2013.01); *E04H 7/02* (2013.01)

(58) Field of Classification Search
CPC ..... B65D 90/105; B65D 90/54; B65D 88/76; B65D 90/22; Y10T 137/7021;
(Continued)

(56) References Cited

U.S. PATENT DOCUMENTS 492,351 A * 2/1893 Emig ..... E03C 1/0401 137/445
843,706 A * 2/1907 Senter ..... A01J 5/04 417/39
(Continued)

FOREIGN PATENT DOCUMENTS

CN 107504277 A 12/2017
CN 206800461 U 12/2017
(Continued)

OTHER PUBLICATIONS

PCT/CN2021/086666—International Search Report, dated Aug. 26, 2021, 3 pages.
(Continued)

*Primary Examiner* — Edwin J Toledo-Duran
(74) *Attorney, Agent, or Firm* — Getech Law LLC; Jun Ye

(57) ABSTRACT

The present disclosure relates to a soil completely-covered tank system with a built-in valve chamber. The valve chamber includes a spherical tank body, a valve chamber, and a channel; an exterior of the spherical tank body is completely
(Continued)

covered with soil, and the spherical tank body is supported by a stand column and is arranged on the ground, such that a gap is formed between the bottom of the spherical tank body and a ground foundation; the valve chamber is arranged between the spherical tank body and the ground foundation; a top opening of the valve chamber is connected to the bottom of the spherical tank body by means of a first connecting structure.

5 Claims, 3 Drawing Sheets

(51) Int. Cl.
*B65D 88/76* (2006.01)
*E02D 27/38* (2006.01)
*E04H 7/02* (2006.01)
*B65D 90/22* (2006.01)

(58) Field of Classification Search
CPC ..... Y10T 137/3802; Y10T 137/8292; Y10T 137/86871; Y10T 137/7006; Y10T 137/6995; Y10T 137/7738; Y10T 137/7039; Y10T 137/7924; Y10T 137/7793; Y10T 137/8175; Y10T 137/86332; Y10T 137/7404; B64F 1/28; B67D 7/04; B67D 7/68; B67D 7/78; F04D 9/04; F04D 9/008; F16K 11/0853; E03F 1/002; F17C 13/04; E02D 27/38; E04H 7/02
See application file for complete search history.

(56) References Cited

U.S. PATENT DOCUMENTS 1,454,971 A * 5/1923 Donnellon ..... B67D 7/78 222/61
1,553,739 A * 9/1925 Belden ..... A01K 7/027 119/73
1,710,844 A * 4/1929 Sherman ..... A01G 25/00 137/382.5
1,741,115 A * 12/1929 Parrish ..... F04F 1/06 417/147
2,336,150 A * 12/1943 Horvath ..... B67D 7/78 137/234.6
2,386,554 A * 10/1945 Holicer ..... F23K 5/22 222/3
2,540,507 A * 2/1951 Brosamer ..... A01K 7/06 251/239
2,564,226 A * 8/1951 Norway ..... F17C 13/04 137/364
2,649,773 A * 8/1953 Griswold ..... F16K 17/32 137/460
3,120,325 A * 2/1964 Tye ..... B67D 7/78 222/204
3,817,858 A * 6/1974 Yost ..... C02F 1/688 210/170.06
3,879,285 A * 4/1975 Yost ..... C02F 3/1242 210/201
3,904,524 A * 9/1975 Pelton ..... B01D 17/0214 220/639
4,036,249 A * 7/1977 Perry, Sr. ..... F16K 11/0853 137/367
4,209,267 A * 6/1980 Gnaedinger ..... F17C 13/126 220/88.1
4,257,439 A * 3/1981 Mayeaux ..... B01F 23/19 422/111
4,926,899 A * 5/1990 Argandona ..... F17D 5/04 137/364
4,960,346 A * 10/1990 Tamayo ..... B65D 90/105 405/129.55
5,435,335 A * 7/1995 Klop ..... F16K 24/046 137/433
5,564,588 A * 10/1996 Reese ..... F17C 13/126 73/49.3
6,340,269 B1 * 1/2002 Stanton ..... B60S 5/02 405/53
6,655,418 B1 * 12/2003 McGill ..... B65D 88/76 141/86
2003/0070985 A1 * 4/2003 Potts ..... E03F 1/002 210/616
2004/0261503 A1 * 12/2004 Hutchinson ..... B67D 7/3209 73/49.2
2006/0118564 A1 * 6/2006 Komarek ..... E03B 11/06 220/565
2007/0131281 A1 * 6/2007 Manger ..... F16K 24/04 137/487.5
2010/0276424 A1 * 11/2010 Ross ..... B65D 90/105 220/320
2011/0178644 A1 * 7/2011 Picton ..... E03B 7/071 700/282
2011/0315381 A1 * 12/2011 Streetman ..... E21B 21/003 166/292
2012/0186660 A1 * 7/2012 Thomas ..... B61D 5/00 137/15.01
2015/0284235 A1 * 10/2015 Blackburn ..... B67D 1/0462 383/93
2016/0334140 A1 * 11/2016 Franck ..... F28D 20/0034
2018/0029864 A1 * 2/2018 Blackburn ..... B05B 9/047
2019/0345021 A1 * 11/2019 Kuehn ..... F16K 31/086
2019/0368824 A1 * 12/2019 Franck ..... B65D 88/76
2020/0131744 A1 * 4/2020 Hunt ..... E03B 7/075
2020/0149647 A1 * 5/2020 Kuehn ..... F16K 17/19
2022/0081882 A1 * 3/2022 Hunt ..... E03B 3/16
2022/0089362 A1 * 3/2022 Franck ..... B65D 90/008

FOREIGN PATENT DOCUMENTS

CN 209926009 U 1/2020
CN 111425753 A 7/2020
CN 212001285 U 11/2020
CN 212078026 U 12/2020
JP 2004083244 A 3/2004
JP 2019031821 A 2/2019

OTHER PUBLICATIONS

CN 202011640962.5—First Office Action, dated Jul. 15, 2021, 18 pages, (with English translation).
CN 202011640962.5—Notice of Allowance, dated Sep. 27, 2021, 7 pages, (with English translation).

* cited by examiner

BUILT-IN VALVE CHAMBER OF TANK COMPLETELY COVERED WITH SOIL

CROSS REFERENCE OF RELATED APPLICATIONS

This is a 371 of International Application No. PCT/CN2021/086666, filed Apr. 12, 2021 which claims priority from Chinese Patent Application No. 202011640962.5, filed on Dec. 31, 2020, the contents of the aforementioned applications are herein incorporated by reference in their entireties.

FIELD

The present disclosure relates to a field of soil-covered tanks, in particular to a soil completely-covered tank system with a built-in valve chamber

BACKGROUND

Soil covering storage means that a liquefied petroleum gas at a normal temperature is pressurized and stored in tanks or under the ground and is subjected to reasonable comprehensive backfill, this technology is very suitable for storing a flammable and explosive liquid material and can be used for protecting tank bodies, preventing heat and shock waves generated by combustion and explosion from affecting other tank bodies, effectively reducing risks and ensuring that the tank body is mounted closer to one another, thereby saving the land. At present, a technology for a soil completely-covered tank system with a built-in valve chamber has not been mature. If a tank body is completely covered with soil, layout control on various pipelines connected to the inside or outside of the tank body and cables of electric control devices is required. The pipelines are required to be provided with valves according to a standard.

SUMMARY

The present disclosure provides a soil completely-covered tank system with a built-in valve chamber If the tank body is covered with soil, various pipelines connected to the inside and outside of the tank body and cables of electric control devices can be accommodated, if an emergency occurs, the pipelines can be more rapidly cut off to the greatest extent via the valve chamber; and the sealing performance of the valve chamber is good, so that various facilities inside the valve chamber can be better protected. The above-mentioned technical problems are solved.

A technical solution for solving the above-mentioned technical problems in the present disclosure is that:

a built-in valve chamber of a tank completely covered with soil includes a spherical tank body, a valve chamber, and a channel; an exterior of the spherical tank body is completely covered with soil, the spherical tank body is connected to a stand column, the stand column is used for supporting the spherical tank body, and the bottom of the stand column is arranged on a ground foundation, such that a gap is formed between the bottom of the spherical tank body and the ground foundation; the valve chamber is arranged between the spherical tank body and the ground foundation, and the valve chamber is provided with a top opening and a side opening; the top opening of the valve chamber is connected to an outer wall on the bottom of the spherical tank body by means of a first connecting structure, such that the valve chamber supports the bottom of the spherical tank body; and the first connecting structure enables a sealed connection state to be formed between the top opening of the valve chamber and the spherical tank body; and one end of the channel is connected to the side opening of the valve chamber by means of a second connecting structure, the other end of the channel extends outwards to be in communication with the outside of a soil layer, and the second connecting structure enables a sealed connection state to be formed between the side opening of the valve chamber and the channel.

In a preferred implementation, the first connecting structure includes a first base plate and a first waterproof layer, the first base plate is arranged between the top opening of the valve chamber and the spherical tank body, and the first waterproof layer is arranged on an outer wall position where the first base plate, the valve chamber and the spherical tank body are connected.

By arranging the base plate between the top opening of the valve chamber and the spherical tank body, the situation that the tank body is damaged to even leak when being extruded by the valve chamber to deform due to direct contact with the top of the valve chamber can be avoided. By arranging the first waterproof layer, the situation that a liquid outside the valve chamber enters into the valve chamber via a gap between the tank body and the valve chamber to damage devices therein can be avoided, and liquid accumulation on a junction of the tank body and the valve chamber, which is unfavorable for the tank body, can also be avoided.

In a preferred implementation, the second connecting structure includes a second base plate, cement, and the first waterproof layer, the second base plate is arranged between the side opening of the valve chamber and the channel, and the cement is arranged on an end, facing the channel, of the second base plate to reinforce the position of the second base plate; and one end of the first waterproof layer is connected to an outer wall of the spherical tank body, and the other end thereof extends to an outer wall on the top of the channel to perform connection, so that the first base plate and the second base plate are sealed at the same time.

By arranging the base plate between the valve chamber and the channel, the situation that direct extrusion occurs between the side wall of the valve chamber and the side wall of the channel to damage the both can be avoided. By arranging the first waterproof layer herein, the situation that the liquid outside the valve chamber enters into the valve chamber and the channel via the gap between the valve chamber and the channel to cause excessively high moisture in internal spaces thereof so as to damage devices therein can be avoided, and meanwhile, the tank body inside the valve chamber can be favorably protected.

In a preferred implementation, an outer wall of the channel is provided with a plurality of deformation joints at intervals, and a spacing distance among the deformation joints does not exceed 10 m.

In the prevent disclosure, the deformation joints are capable of controlling the generation and development of cracks, avoiding collapse, damage of the tank body and more serious hazards, and are beneficial to the guarantee for the structural firmness and stability of the valve chamber and the channel.

In a preferred implementation, a third base plate is arranged in the deformation joints, an inner side, facing the channel, of the deformation joint is provided with the cement for reinforcing the third base plate, an outer side thereof is provided with a second waterproof layer, and an exterior of the second waterproof layer is covered with soil.

By arranging the third base plate, the situation that the side wall structure of the channel is damaged by direct mutual extrusion between structures on two sides of the third base plate to lower the supporting strength for covering soil can be avoided. The arrangement of the second waterproof layer is beneficial to the maintenance of a relatively dry state inside the channel and the valve chamber and the avoidance of damage of internal facilities affected with damp and is also beneficial to the prolonging of the service life of the third base plate.

In a preferred implementation, all of the first base plate, the second base plate and the third base plate are set as wood fiber plates dipped with emulsified asphalt, the cement is set as polyvinyl chloride cement, and both of the first waterproof layer and the second waterproof layer are set as self-adhesive waterproof rolls. The above-mentioned materials can play a better waterproofing role and is beneficial to the guarantee for the structural safety and stability of the built-in valve chamber.

In a preferred implementation, an exterior of the second waterproof layer is provided with a protective layer, and the protective layer includes a top protective layer, a bottom protective layer, and a side protective layer; the top protective layer is arranged on the top of the valve chamber and is made of fine aggregate concrete which is 70 mm thick; the bottom protective layer is arranged on the bottom of the valve chamber and is made of fine aggregate concrete which is 50 mm thick; and the side protective layer is arranged on the side of the valve chamber and is made of a soft protective material.

By arranging the above-mentioned protective layers, the second waterproof layer is not in direct contact with the covering soil, which is beneficial to the protection of the second waterproof layer from being damaged, and thus, its waterproof effect can be guaranteed.

In a preferred implementation, main bodies of the valve chamber and the channel are made of reinforced concrete. By adopting the above-mentioned structure, the supporting stability of the valve chamber for the tank body is higher, collapse cannot be easily caused, the safety of the tank body can be favorably guaranteed, and greater dangers are avoided.

In a preferred implementation, a bedding layer is arranged on the bottoms of the valve chamber and the channel, and the bedding layer is set as plain concrete; and the lower part of the bedding layer is provided with a graded sand and stone layer of which the compaction coefficient is not smaller than 0.96.

By adopting the above-mentioned structure, a bottom structure where the tank body is located is more stable and reliable, and the situation that serious deformation occurs on the bottom structure to result in the deflection of the tank body and even trigger the collapse and explosion of the tank body can be avoided.

In a preferred implementation, a fireproof door is arranged on a position, close to the side opening of the valve chamber, in the channel, and an anti-theft door is arranged on a position, close to an exit of the channel, in the channel. By arranging the fireproof door, the situation that a fire source outside or inside the door spreads to cause higher loss can be stopped. The arrangement of the anti-theft door is beneficial to the guarantee for the safety of the facilities inside the valve chamber.

By adopting the above-mentioned structure, the present disclosure has the beneficial effects that: after the tank body is covered with soil, various pipelines connected to the inside and outside of the tank body and cables of electric control devices can be accommodated, if an emergency occurs, the pipelines can be more rapidly cut off to the greatest extent via the valve chamber; and the sealing performance of the valve chamber is good, so that various facilities inside the valve chamber can be better protected.

BRIEF DESCRIPTION OF THE DRAWINGS

The accompanying drawings described herein are provided for further understanding of the present disclosure, and constitute one part of the present disclosure. Exemplary embodiments of the present disclosure and their descriptions are intended to explain the present disclosure, rather than to constitute improper limitations on the present disclosure. In the accompanying drawings.

In the drawings.

Figure 1:
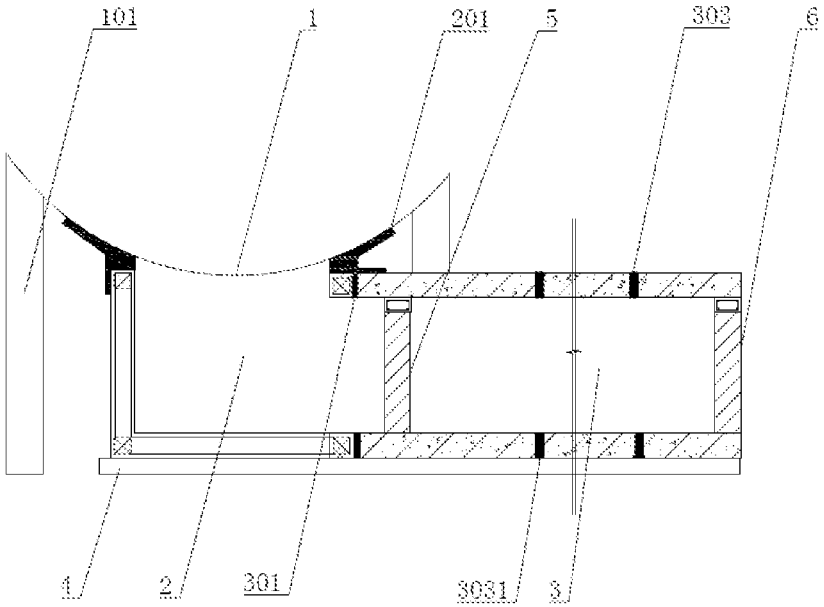
FIG. 1 is a schematic view of a sectional structure of the present disclosure.

1, spherical tank body; 101, stand column;

2, valve chamber; 201, first connecting structure; 2011, first base plate; 2012, first waterproof layer;

3, channel; 301, second connecting structure; 302, second base plate; 303, deformation joint; 3031, third base plate; 3032, cement; 3033, second waterproof layer;

4, bedding layer; 5, fireproof door; and 6, anti-theft door.

DETAILED DESCRIPTION OF THE EMBODIMENTS

In order to describe the overall concept of the present disclosure more clearly, detailed descriptions will be further shown below with reference to the accompanying drawings of the description by way of examples.

It needs to be noted that many concrete details are shown in the following descriptions to facilitate the sufficient understanding of the present disclosure, however, the present disclosure can also be implemented in other ways different from the ways described herein, and therefore, the protection scope of the present disclosure is not limited by the specific embodiments disclosed below.

As shown in FIG. 1 to FIG. 4, a soil completely-covered tank system with a built-in valve chamber 2 includes a spherical tank body 1, a valve chamber 2, and a channel 3; an exterior of the spherical tank body 1 is completely covered with soil, the spherical tank body 1 is connected to a stand column 101, the stand column 101 is used for supporting the spherical tank body 1, and the bottom of the stand column 101 is arranged on a ground foundation, such that a gap is formed between the bottom of the spherical tank body 1 and the ground foundation; the valve chamber 2 is arranged between the spherical tank body 1 and the ground foundation, and the valve chamber 2 is provided with a top opening and a side opening; the top opening of the valve chamber 2 is connected to the outer wall on the bottom of the spherical tank body 1 by means of a first connecting structure 201, such that the valve chamber 2 supports the bottom of the spherical tank body 1; and the first connecting structure 201 enables a sealed connection state to be formed between the top opening of the valve chamber 2 and the spherical tank body 1; and one end of the channel 3 is connected to the side opening of the valve chamber 2 by means of a second connecting structure 301, the other end of the channel 3 extends outwards to be in communication with an outside of a soil layer, and the second connecting structure enables a sealed connection state to be formed between the side opening of the valve chamber 2 and the channel 3.

In a preferred implementation, the first connecting structure 201 includes a first base plate 2011 and a first waterproof layer 2012, the first base plate 2011 is arranged between the top opening of the valve chamber 2 and the spherical tank body 1, and the first waterproof layer 2012 is arranged on an outer wall position where the first base plate 2011, the valve chamber 2 and the spherical tank body 1 are connected.

By arranging the base plate between the top opening of the valve chamber 2 and the spherical tank body 1, the situation that the tank body is damaged to even leak when being extruded by the valve chamber 2 to deform due to direct contact with the top of the valve chamber 2 can be avoided. By arranging the first waterproof layer 2012, the situation that a liquid outside the valve chamber 2 enters into the valve chamber 2 via a gap between the tank body and the valve chamber 2 to damage devices therein can be avoided, and liquid accumulation on a junction of the tank body and the valve chamber 2, which is unfavorable for the tank body, can also be avoided.

Figure 2:
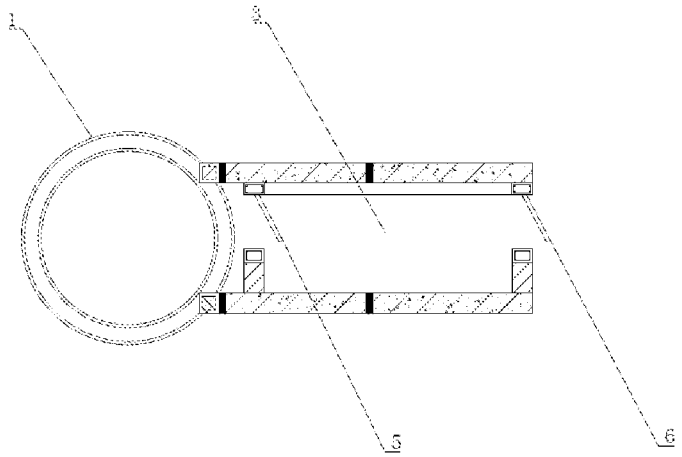
FIG. 2 is a schematic view of a partial vertical-view structure of the present disclosure.
Figure 3:
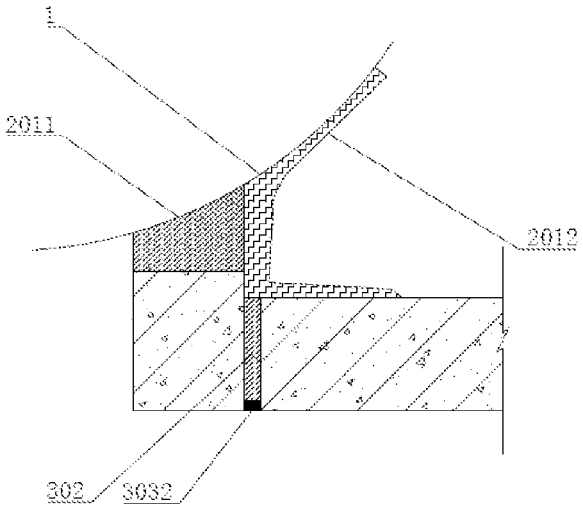
FIG. 3 is a partial sectional view of a first connecting structure and a second connecting structure of the present disclosure.
Figure 4:
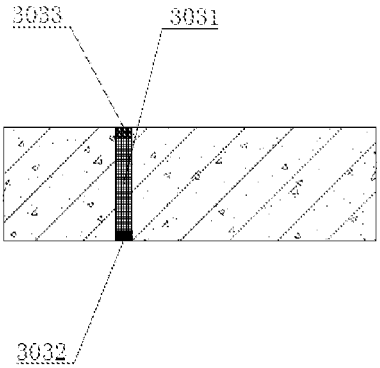
FIG. 4 is a schematic view of a partial structure of a deformation joint of the present disclosure.

As shown in FIG. 1 to FIG. 3, the second connecting structure 301 includes a second base plate 302, cement 3032, and the first waterproof layer 2012, the second base plate 302 is arranged between the side opening of the valve chamber 2 and the channel 3, and the cement 3032 is arranged on an end, facing the channel 3, of the second base plate 302 to reinforce the position of the second base plate 302; and one end of the first waterproof layer 2012 is connected to the outer wall of the spherical tank body 1, and the other end thereof extends to an outer wall on the top of the channel 3 to perform connection, so that the first base plate 2011 and the second base plate 302 are sealed at the same time.

By arranging the base plate between the valve chamber 2 and the channel 3, the situation that direct extrusion occurs between the side wall of the valve chamber 2 and the side wall of the channel 3 to damage the both can be avoided. By arranging the first waterproof layer 2012 herein, the situation that the liquid outside the valve chamber 2 enters into the valve chamber 2 and the channel 3 via the gap between the valve chamber 2 and the channel 3 to cause excessively high moisture in internal spaces thereof so as to damage devices therein can be avoided, and meanwhile, the tank body inside the valve chamber 2 can be favorably protected.

As shown in FIG. 1 to FIG. 4, an outer wall of the channel 3 is provided with a plurality of deformation joints 303 at intervals, and a spacing distance among the deformation joints 303 does not exceed 10 m.

In the prevent disclosure, the deformation joints 303 are capable of controlling the generation and development of cracks, avoiding collapse, damage of the tank body and more serious hazards, and are beneficial to the guarantee for the structural firmness and stability of the valve chamber 2 and the channel 3.

Further, a third base plate 3031 is arranged in the deformation joints 303, an inner side, facing the channel 3, of the deformation joint 303 is provided with the cement 3032 for reinforcing the third base plate 3031, an outer side thereof is provided with a second waterproof layer 3033, and an exterior of the second waterproof layer 3033 is covered with soil.

By arranging the third base plate 3031, the situation that the side wall structure of the channel 3 is damaged by direct mutual extrusion between structures on two sides of the third base plate to lower the supporting strength for covering soil can be avoided. The arrangement of the second waterproof layer 3033 is beneficial to the maintenance of a relatively dry state inside the channel 3 and the valve chamber 2 and the avoidance of damage of internal facilities affected with damp and is also beneficial to the prolonging of the service life of the third base plate 3031.

Further, all of the first base plate 2011, the second base plate 302 and the third base plate 3031 are set as wood fiber plates dipped with emulsified asphalt, the cement 3032 is set as polyvinyl chloride cement 3032, and both of the first waterproof layer 2012 and the second waterproof layer 3033 are set as self-adhesive waterproof rolls. The above-mentioned materials can play a better waterproofing role and is beneficial to the guarantee for the structural safety and stability of the built-in valve chamber 2.

Further, an exterior of the second waterproof layer 3033 is provided with a protective layer, and the protective layer includes a top protective layer, a bottom protective layer, and a side protective layer; the top protective layer is arranged on the top of the valve chamber 2 and is made of fine aggregate concrete which is 70 mm thick; the bottom protective layer is arranged on the bottom of the valve chamber 2 and is made of fine aggregate concrete which is 50 mm thick; and the side protective layer is arranged on the side of the valve chamber 2 and is made of a soft protective material.

By arranging the above-mentioned protective layers, the second waterproof layer 3033 is not in direct contact with the covering soil, which is beneficial to the protection of the second waterproof layer 3033 from being damaged, and thus, its waterproof effect can be guaranteed.

Further, main bodies of the valve chamber 2 and the channel 3 are made of reinforced concrete. By adopting the above-mentioned structure, the supporting stability of the valve chamber 2 for the tank body is higher, collapse cannot be easily caused, the safety of the tank body can be favorably guaranteed, and greater dangers are avoided.

In a preferred implementation, a bedding layer 4 is arranged on the bottoms of the valve chamber 2 and the channel 3, and the bedding layer 4 is set as plain concrete; and the lower part of the bedding layer 4 is provided with a graded sand and stone layer of which the compaction coefficient is not smaller than 0.96.

By adopting the above-mentioned structure, a ground foundation where the tank body is located is more stable and reliable, and the situation that serious deformation occurs on the ground foundation to result in the deflection of the tank body and even trigger the collapse and explosion of the tank body can be avoided.

In a preferred implementation, a fireproof door 5 is arranged on a position, close to the side opening of the valve chamber 2, in the channel 3, and an anti-theft door 6 is arranged on a position, close to an exit of the channel 3, in the channel 3. By arranging the fireproof door 5, the situation that a fire source outside or inside the fireproof door 5 spreads to cause higher loss can be stopped. The arrangement of the anti-theft door 6 is beneficial to the guarantee for the safety of the facilities inside the valve chamber.

The technical solutions to be protected in the present disclosure are not limited to the above-mentioned embodiments. It should be indicated that combinations of the technical solution in any one of the embodiments and technical solutions in one or more of other embodiments fall within the protection scope of the present disclosure.

Although the present disclosure has been described in detail with generalized descriptions and specific embodiments as above, some modifications or improvements may be made on the basis of the present disclosure, which is apparent for the skilled in the art. Therefore, all of these modifications or improvements made without departing from the spirit of the present disclosure fall within the scope claimed to be protected in the present disclosure.

What is claimed:

1. A soil completely-covered tank system with a built-in valve chamber, comprising:

a spherical tank body, an exterior of the spherical tank body being completely covered with soil, the spherical tank body being connected to a stand column, the stand column being used for supporting the spherical tank body, and the bottom of the stand column being arranged on a ground foundation, such that a gap is formed between the bottom of the spherical tank body and the ground foundation;

a valve chamber, the valve chamber being arranged between the spherical tank body and the ground foundation, and the valve chamber being provided with a top opening and a side opening; the top opening of the valve chamber being connected to an outer wall on the bottom of the spherical tank body by means of a first connecting structure, such that the valve chamber supports the bottom of the spherical tank body; and the first connecting structure enabling a sealed connection state to be formed between the top opening of the valve chamber and the spherical tank body; and a channel, one end of the channel being connected to the side opening of the valve chamber by means of a second connecting structure, the other end of the channel extending outwards to be in communication with an outside of a soil layer, and the second connecting structure enabling a sealed connection state to be formed between the side opening of the valve chamber and the channel, the first connecting structure comprises a first base plate and a first waterproof layer, the first base plate is arranged between the top opening of the valve chamber and the spherical tank body, and the first waterproof layer is arranged on an outer wall position where the first base plate, the valve chamber and the spherical tank body are connected; the second connecting structure comprises a second base plate, cement, and the first waterproof layer, the second base plate is arranged between the side opening of the valve chamber and the channel, and the cement is arranged on an end, facing the channel, of the second base plate to reinforce the position of the second base plate; and one end of the first waterproof layer is connected to an outer wall of the spherical tank body, and the other end thereof extends to an outer wall on the top of the channel to perform connection, so that the first base plate and the second base plate are sealed at the same time;

an outer wall of the channel is provided with a plurality of deformation joints at intervals, and a spacing distance among the deformation joints does not exceed 10 m; a third base plate is arranged in the deformation joints, an inner side, facing the channel, of the deformation joint is provided with the cement for reinforcing the third base plate, an outer side thereof is provided with a second waterproof layer, and an exterior of the second waterproof layer is covered with soil; all of the first base plate, the second base plate and the third base plate are set as wood fiber plates dipped with emulsified asphalt, the cement is set as polyvinyl chloride cement, and both of the first waterproof layer and the second waterproof layer are set as self-adhesive waterproof rolls.

2. The soil completely-covered tank system with the built-in valve chamber of claim 1, wherein an exterior of the second waterproof layer is provided with a protective layer, and the protective layer comprises a top protective layer, a bottom protective layer, and a side protective layer; the top protective layer is arranged on the top of the valve chamber and is made of fine aggregate concrete which is 70 mm thick; the bottom protective layer is arranged on the bottom of the valve chamber and is made of fine aggregate concrete which is 50 mm thick; and the side protective layer is arranged on the side of the valve chamber and is made of a soft protective material.

3. The soil completely-covered tank system with the built-in valve chamber of claim 1, wherein main bodies of the valve chamber and the channel are made of reinforced concrete.

4. The soil completely-covered tank system with the built-in valve chamber of claim 3, wherein a bedding layer is arranged on the bottoms of the valve chamber and the channel, and the bedding layer is set as plain concrete; and the lower part of the bedding layer is provided with a graded sand and stone layer of which the compaction coefficient is not smaller than 0.96.

5. The soil completely-covered tank system with the built-in valve chamber of claim 1, wherein a fireproof door is arranged on a position, close to the side opening of the valve chamber, in the channel, and an anti-theft door is arranged on a position, close to an exit of the channel, in the channel.

* * * * *